US011391082B2

(12) United States Patent
Hervey

(10) Patent No.: US 11,391,082 B2
(45) Date of Patent: Jul. 19, 2022

(54) DRESSER INTEGRATED SAFE APPARATUS

(71) Applicant: Bonita Hervey, Anderson, IN (US)

(72) Inventor: Bonita Hervey, Anderson, IN (US)

( * ) Notice: Subject to any disclaimer, the term of this patent is extended or adjusted under 35 U.S.C. 154(b) by 402 days.

(21) Appl. No.: 16/732,439

(22) Filed: Jan. 2, 2020

(65) Prior Publication Data

US 2021/0207423 A1 Jul. 8, 2021

(51) Int. Cl.
*E05G 1/00* (2006.01)
*E05B 65/00* (2006.01)
*E05G 1/04* (2006.01)

(52) U.S. Cl.
CPC ..... *E05G 1/005* (2013.01); *E05B 65/0075* (2013.01); *E05G 1/04* (2013.01)

(58) Field of Classification Search
CPC ..... Y10T 70/5097; Y10T 70/5111; Y10T 70/5128; Y10T 70/5133; A47B 2210/0016; A47B 17/04; E05B 65/46; E05B 65/0075; E05B 65/44; E05B 65/462; E05G 1/005; E05G 1/06; E05G 1/08; E05G 1/04
USPC ..... 109/47, 56, 57; 312/204, 215, 333
See application file for complete search history.

(56) References Cited

U.S. PATENT DOCUMENTS 180,904 A 8/1876 McIntyre
1,512,937 A 10/1924 Knaster
1,847,986 A * 3/1932 Schuette ..... A47B 63/00 312/204
2,062,417 A * 12/1936 Allen ..... E05G 1/026 292/259 R
2,664,331 A 12/1953 Glofelter
3,587,486 A * 6/1971 Heinrichs ..... A47B 17/00 109/51
4,252,387 A 2/1981 Wagner
4,341,166 A * 7/1982 Cantley ..... E05G 1/08 312/333
4,681,381 A * 7/1987 Sevey ..... A47B 88/43 312/334.47
4,832,163 A 5/1989 Levesque
5,317,888 A * 6/1994 Towns ..... A47C 19/22 109/51
D448,205 S 9/2001 O'Hare
7,028,621 B2 * 4/2006 Mercier ..... E05G 1/04 70/81
8,132,875 B2 * 3/2012 Juang ..... A47B 88/49 312/334.47
2003/0090186 A1 * 5/2003 Weng ..... A47B 88/467 312/333
2003/0141791 A1 * 7/2003 Dubon ..... H05K 7/1489 312/334.44

(Continued)

*Primary Examiner* — Lloyd A Gall

(57) ABSTRACT

A dresser integrated safe apparatus for preventing dressers from tipping and providing safekeeping includes a dresser frame and a plurality of tracks coupled to the dresser frame and positioned on a frame left side and a frame right side within a frame inside adjacent a plurality of drawer apertures. A plurality of drawers each has a pair of drawer rails to slidingly engage the tracks. A safe body has a pair of safe rails to slidingly engage the tracks adjacent a lowest drawer aperture of the plurality of drawer apertures. A safe door is hingingly coupled to the safe body. The safe door covers and alternatively exposes a safe cavity of the safe body. A safe control is coupled within the safe door. The safe control includes a door lock to secure and alternatively release the safe door.

10 Claims, 6 Drawing Sheets

(56) References Cited

U.S. PATENT DOCUMENTS

| | | | | |
|---|---|---|---|---|
| 2003/0234602 | A1* | 12/2003 | Cutler | A47B 88/43 312/334.4 |
| 2005/0264141 | A1 | 12/2005 | Whitall | |
| 2006/0152339 | A1* | 7/2006 | Mercier | G07F 17/12 340/5.73 |
| 2012/0257845 | A1* | 10/2012 | Fan | H05K 7/1489 384/35 |
| 2014/0111077 | A1* | 4/2014 | Kuo | G11B 33/128 312/333 |
| 2015/0043152 | A1* | 2/2015 | Zhang | G11B 33/124 312/333 |
| 2016/0186465 | A1* | 6/2016 | Nelson | E05B 65/0075 220/230 |
| 2019/0178021 | A1 | 6/2019 | Kohli | |

* cited by examiner

DRESSER INTEGRATED SAFE APPARATUS

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to storage devices and more particularly pertains to a new storage device for preventing dressers from tipping and providing safekeeping.

(2) Description of Related Art Including Information Disclosed Under 37 CFR 1.97 and 1.98

The prior art relates to storage devices both for traditional storage, such as dressers, and for safekeeping, such as fireproof safes and lockboxes. Existing dressers that also include safes typically function as a façade to hide the safe and sacrifice the function of the drawers. The safe in existing devices also does not integrate with the rails of the dresser to slide in and out for easy access and removal.

BRIEF SUMMARY OF THE INVENTION

An embodiment of the disclosure meets the needs presented above by generally comprising a dresser frame including a frame top side separated from a frame bottom side, a frame left side separated from a frame right side, and a frame front side separated from a frame back side defining a frame inside. The frame front side has a plurality of drawer apertures extending through to the frame inside. A plurality of tracks is coupled to the dresser frame and positioned on the frame left side and the frame right side within the frame inside adjacent the drawer apertures. A plurality of drawers each has a pair of drawer rails to slidingly engage the tracks. A safe body has a pair of safe rails to slidingly engage the tracks adjacent a lowest drawer aperture of the plurality of drawer apertures. A safe door is hingingly coupled to the safe body. The safe door covers and alternatively exposes a safe cavity of the safe body. A safe control is coupled within the safe door. The safe control includes a door lock to secure and alternatively release the safe door.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
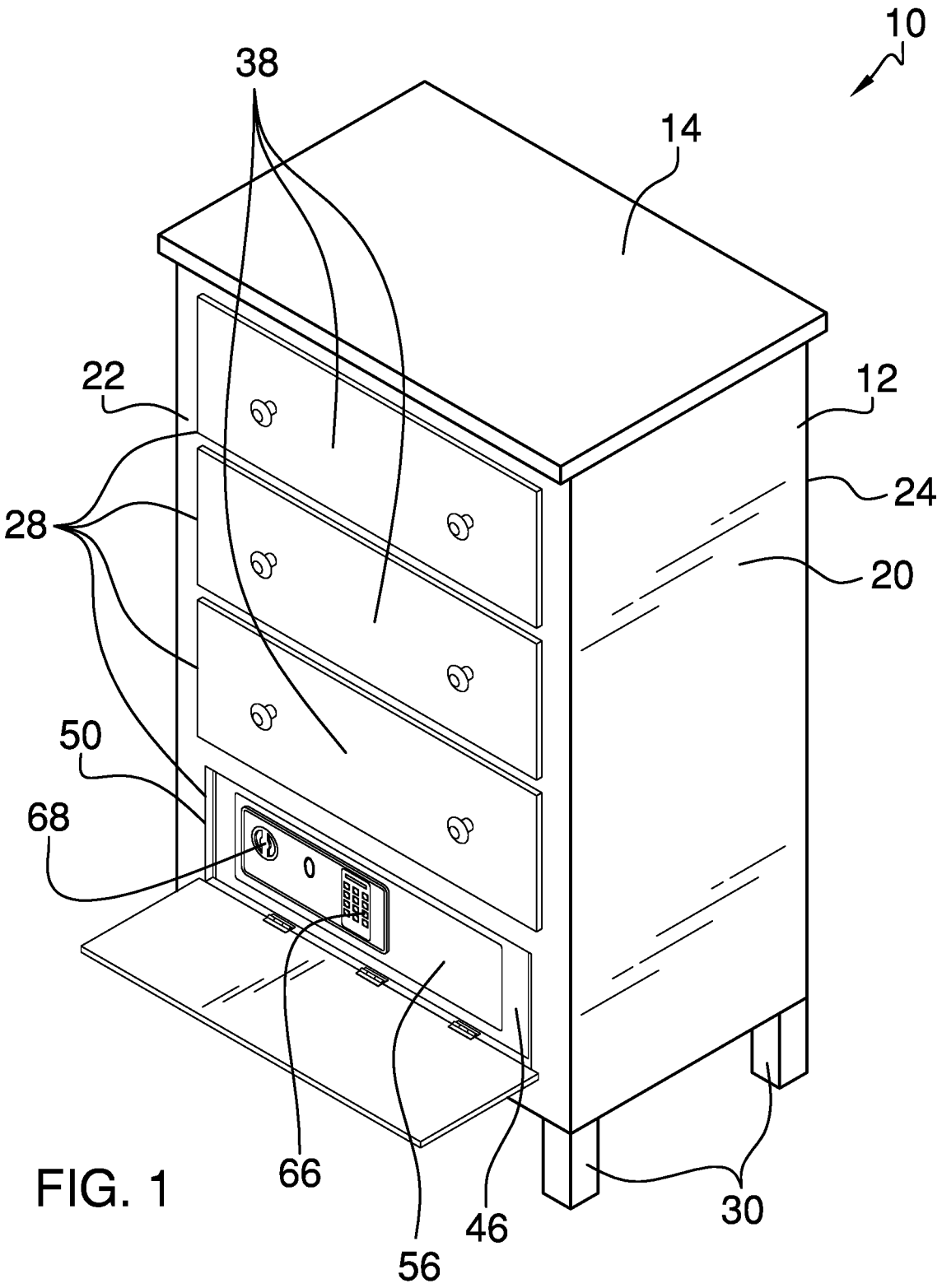
FIG. 1 is an isometric view of a dresser integrated safe apparatus according to an embodiment of the disclosure.
Figure 2:
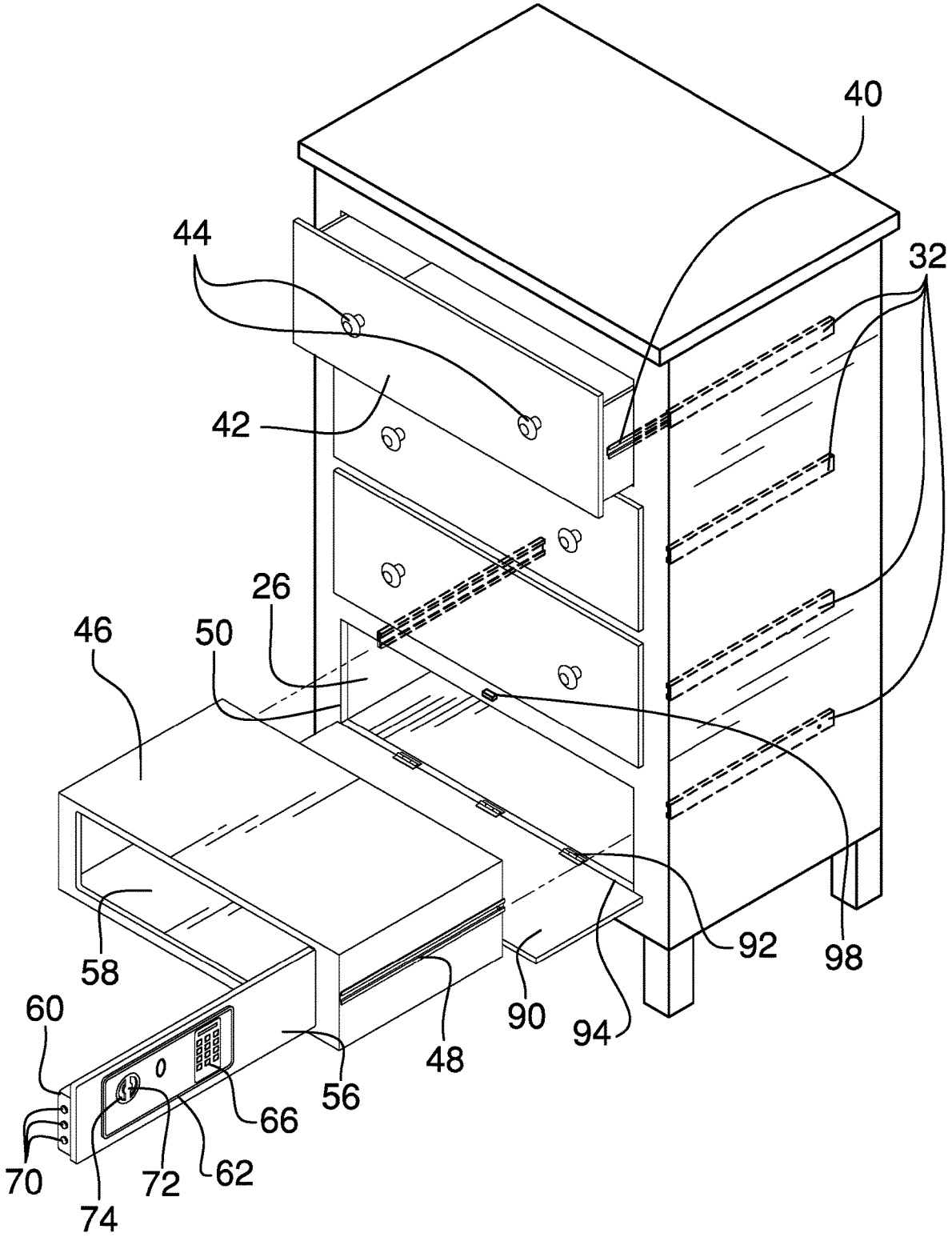
FIG. 2 is an isometric view of an embodiment of the disclosure.
Figure 3:
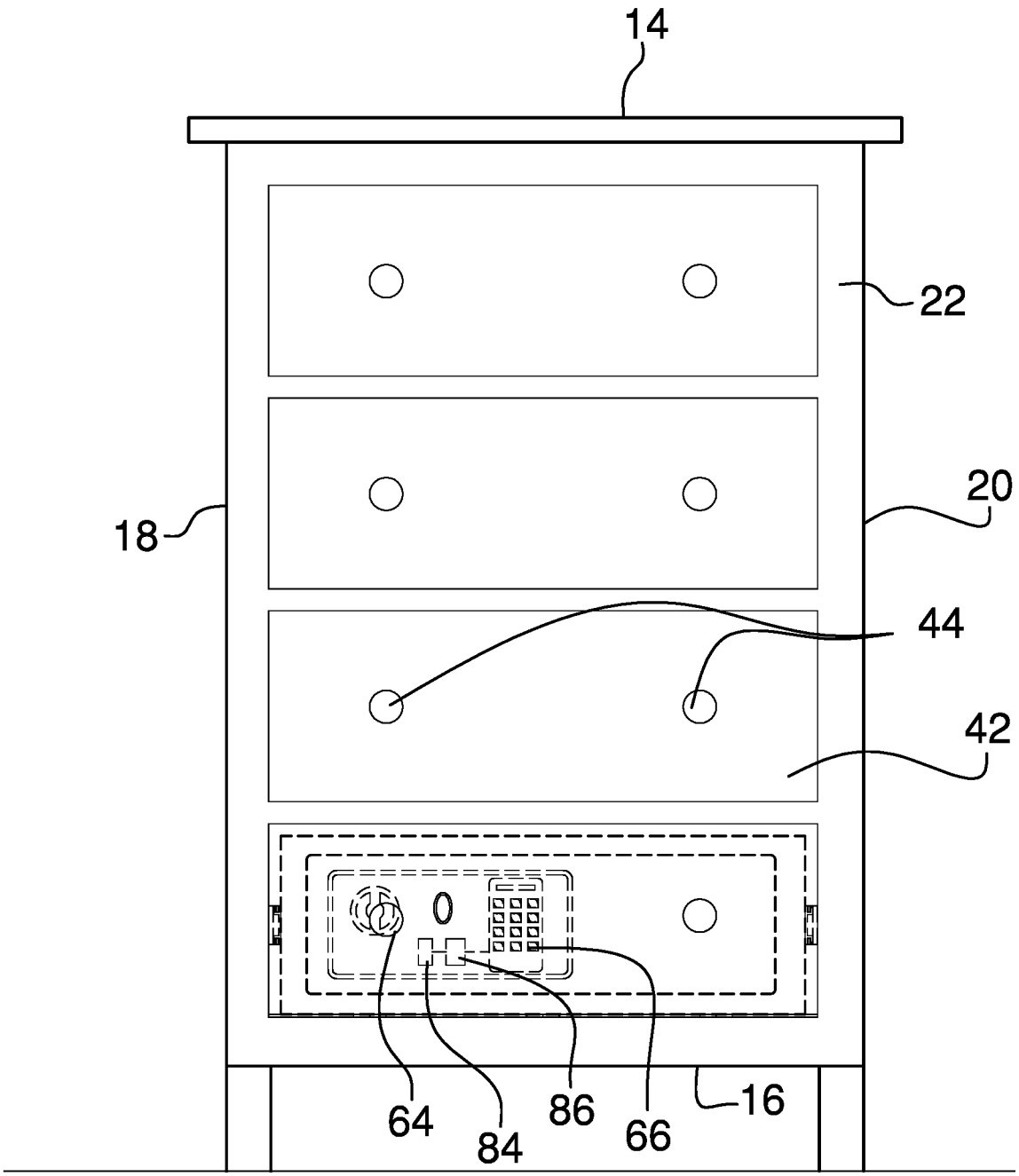
FIG. 3 is a front elevation view of an embodiment of the disclosure.
Figure 4:
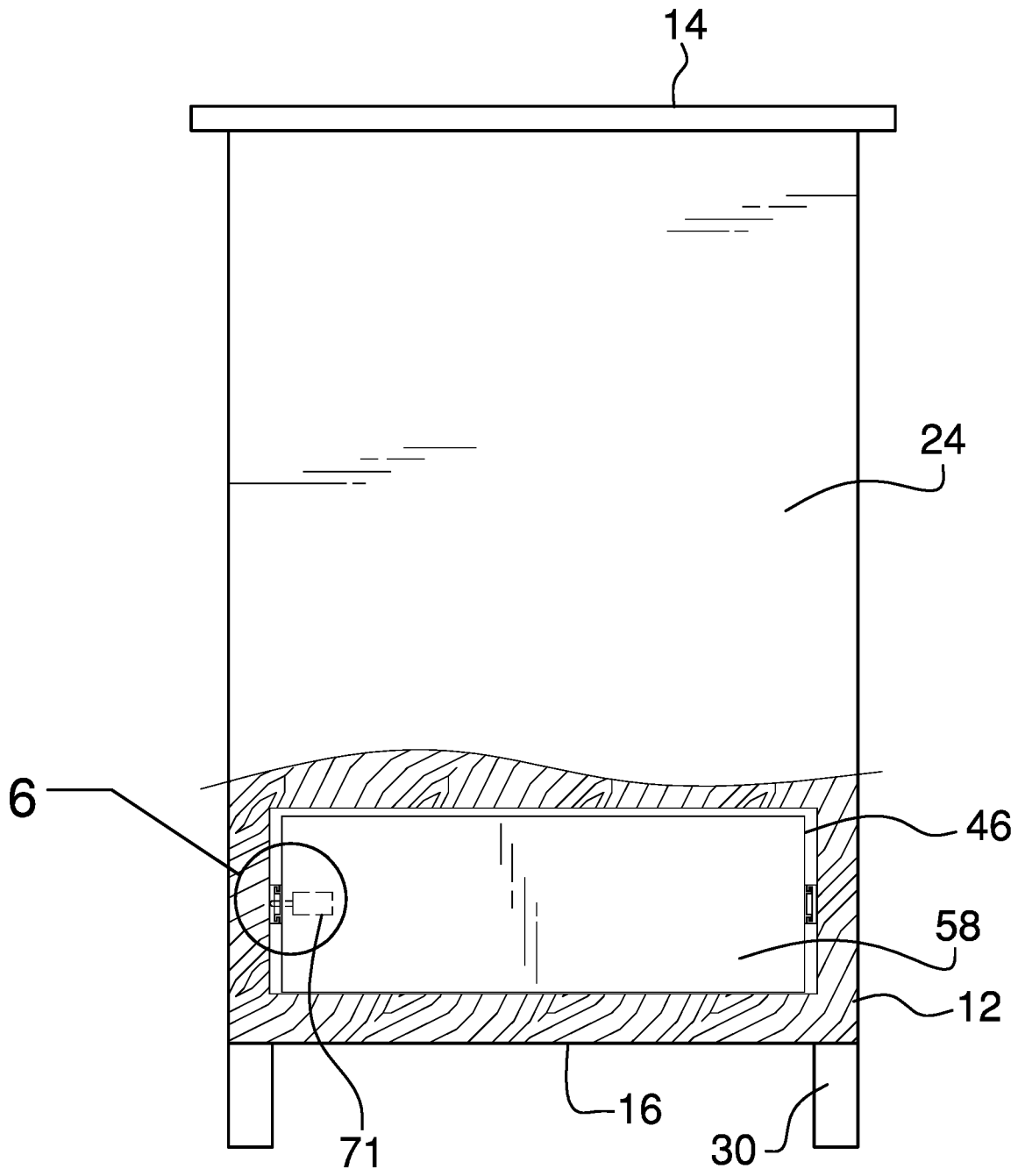
FIG. 4 is a rear elevation view of an embodiment of the disclosure.
Figure 5:
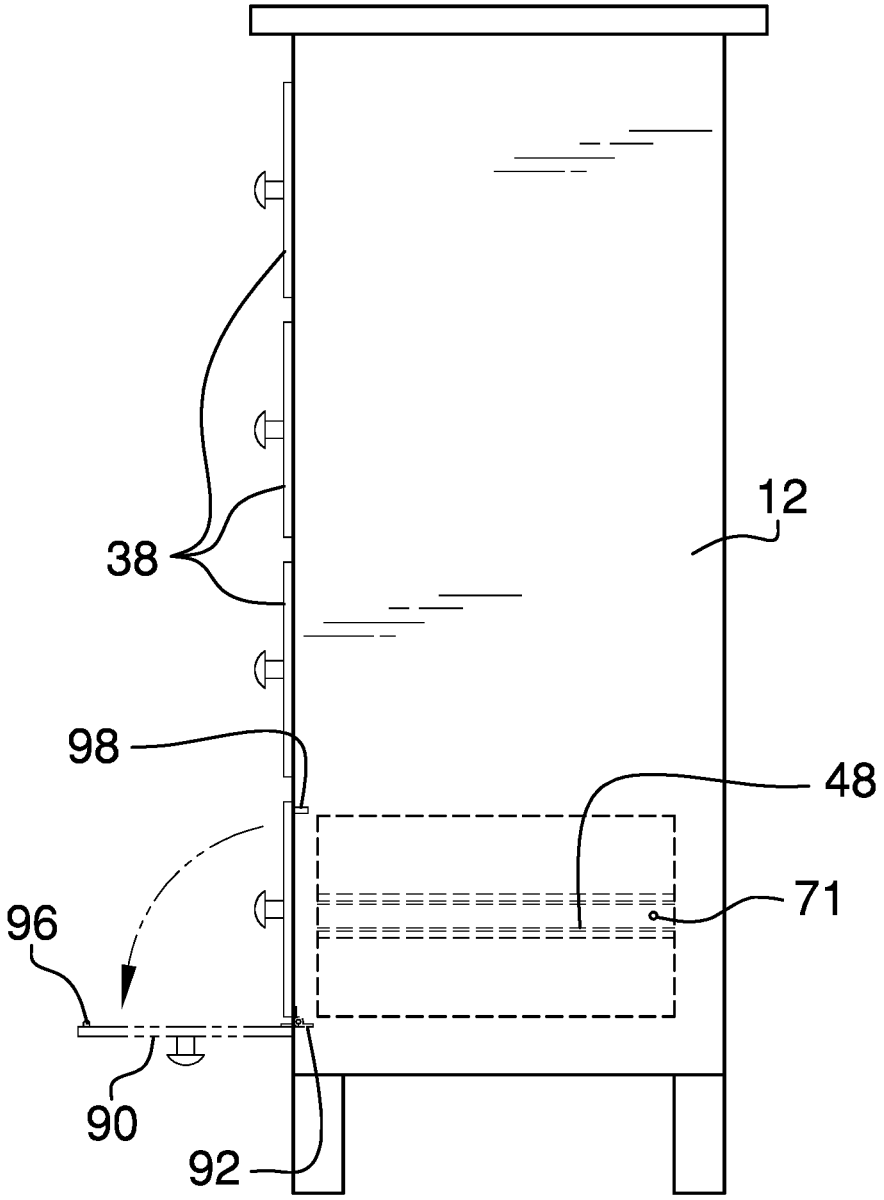
FIG. 5 is a side elevation view of an embodiment of the disclosure.
Figure 6:
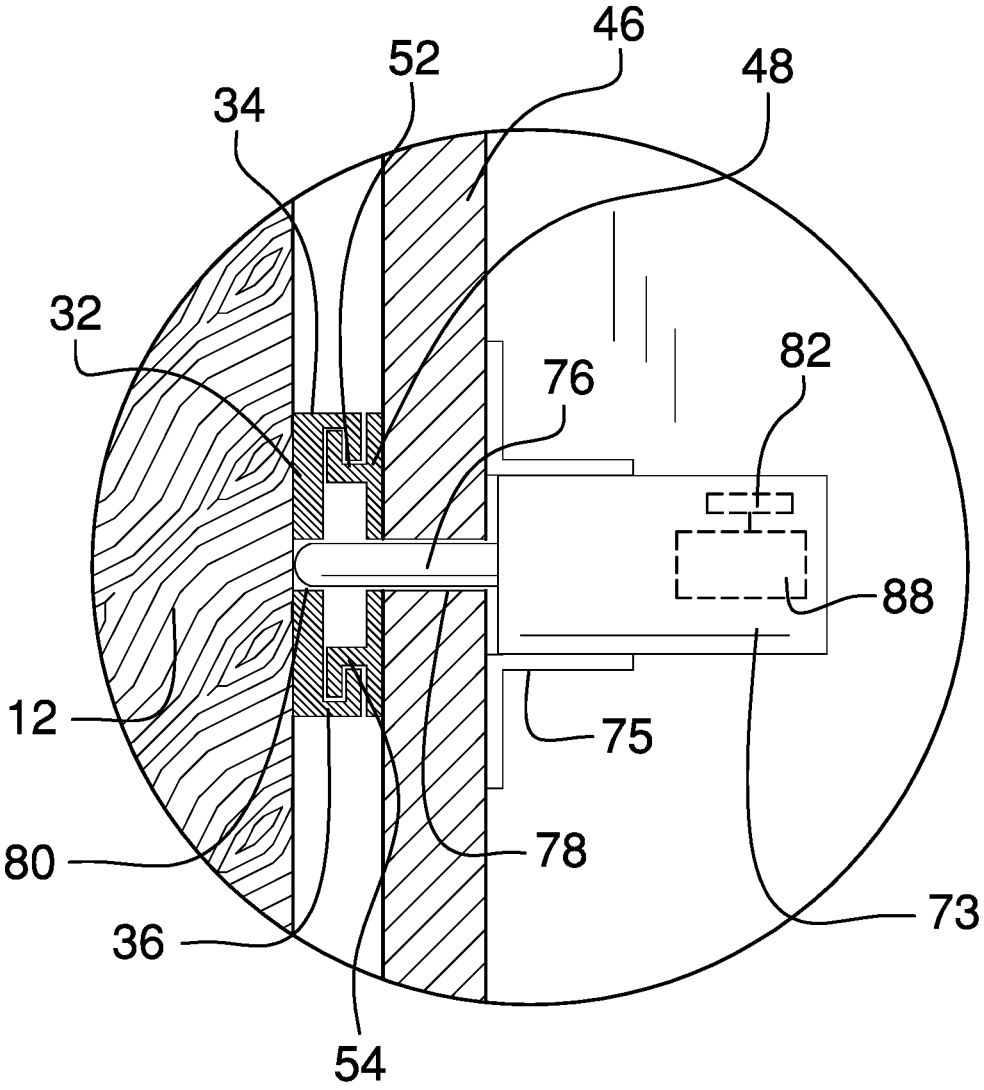
FIG. 6 is a detail view of an embodiment of the disclosure.

With reference now to the drawings, and in particular to FIGS. 1 through 6 thereof, a new storage device embodying the principles and concepts of an embodiment of the disclosure and generally designated by the reference numeral 10 will be described.

As best illustrated in FIGS. 1 through 6, the dresser integrated safe apparatus 10 generally comprises a dresser frame 12 including a frame top side 14 separated from a frame bottom side 16, a frame left side 18 separated from a frame right side 20, and a frame front side 22 separated from a frame back side 24 defining a frame inside 26. The frame front side 22 has a plurality of drawer apertures 28 extending through to the frame inside 26. There may be a set of legs 30 coupled to the frame bottom side 16 to support the dresser frame 12.

A plurality of tracks 32 is coupled to the dresser frame 12. The plurality of tracks 32 is positioned on the frame left side 18 and the frame right side 20 within the frame inside 26 and adjacent the drawer apertures 28. Each track 32 may have an upper squared U-shape portion 34 and a lower squared U-shape portion 36. Each of a plurality of drawers 38 has a pair of drawer rails 40 to slidingly engage the tracks 32. Each drawer 38 functions as in a standard dresser to store items such as clothing. Each drawer 38 may have a drawer face 42 and a pair of drawer knobs 44 coupled to the drawer face.

A safe body 46 has a pair of safe rails 48 to slidingly engage the tracks 32 adjacent a lowest drawer aperture 50 of the plurality of drawer apertures 28. Each drawer rail 40 and each safe rail 48 may have an upper L-shaped extension 52 and a lower L-shaped extension 54 to engage within the upper U-shape portion 34 and the lower U-shape portion 36 of the track, respectively. The safe rails 48 conform to the shape of the drawer rails 40 and may be a standard shape to function with any dresser. A safe door 56 is hingingly coupled to the safe body 46 to cover and alternatively expose a safe cavity 58 of the safe body. The safe door 56 may have an extended back side 60 conforming to the perimeter of the safe cavity 58.

A safe control 62 is coupled within the safe door 56. The safe control 62 includes a door lock 64 to secure and alternatively release the safe door 56. The safe control 62 may comprise a keypad 66 in operational communication with the door lock 64 and the door lock 64 may include a rotary handle 68 in operational communication with a plurality of engagement rods 70. The rotary handle 68 may have a medial bar 72 extending across a circular perimeter 74 to be secured by a user to pull the safe body 46 out of the lowest drawer aperture 50, as well as to rotate the rotary handle 68 to open the safe door 56.

A rail lock 71 is coupled to the safe body 46 and is selectively engageable with the tracks 32 to prevent the safe body 46 from sliding out of the lowest drawer aperture 50 until disengaged. The rail lock 71 thus prevents unauthorized removal and theft of the safe body 46. The rail lock 71 may include an actuator 73 coupled within the safe body 46 and supported by a flanged bracket 75. The actuator 73 selectively extends a pin 76 through a pin aperture 78 of the safe body to engage and alternatively disengage a pin receptacle 80 within the track 32 adjacent the rail lock 71. The actuator 73 may have a wireless receiver 82 in operational communication with a transmitter 84 of the safe control 62. The safe control 62 has a first battery 86 and the actuator 73 has a second battery 88.

A drawer façade 90 is hingingly coupled to the dresser frame 12 adjacent the lowest drawer aperture 50. The drawer façade 90 covers and alternatively exposes the lowest drawer aperture 50 to hide or expose the safe door 56. The drawer façade 90 conforms to the shape and appearance of the drawer face 42 and drawer knobs 44 to maintain the appearance of a traditional dresser to prevent attempted theft. The drawer façade 90 may have a façade hinge 92 coupled along a bottom edge 94 and a façade engagement member 96 selectively engageable with a façade receiving member 98 coupled within the frame front side 22 above the lowest drawer aperture 50. The façade engagement member 96 and the façade receiving member 98 may be, but are not limited to, magnets, latches, or other selectively engageable members.

In use, the weight of the safe body 46 and the contents of the safe cavity 58 help stabilize the dresser frame 12 and prevent the apparatus 10 from falling and injuring children. The drawers 38 are used for traditional means. The drawer façade 90 is lowered to expose the safe door 56 and the safe control 62 is used to disengage the rail lock 71 to remove the safe body 46. The safe control 62 is used to open the safe door 56 to access the contents of the safe cavity 58 when desired.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A dresser integrated safe apparatus comprising:

a dresser frame including a frame top side separated from a frame bottom side, a frame left side separated from a frame right side, and a frame front side separated from a frame back side defining a frame inside, the frame front side having a plurality of drawer apertures extending through to the frame inside;

a plurality of tracks coupled to the dresser frame, the plurality of tracks being positioned on the frame left side and the frame right side within the frame inside and adjacent the drawer apertures;

a plurality of drawers, each drawer having a pair of drawer rails to slidingly engage the tracks;

a safe body having a pair of safe rails to slidingly engage the tracks adjacent a lowest drawer aperture of the plurality of drawer apertures;

a safe door hingingly coupled to the safe body, the safe door covering and alternatively exposing a safe cavity of the safe body; and a safe control coupled within the safe door, the safe control including a door lock to secure and alternatively release the safe door.

2. The dresser integrated safe apparatus of claim 1 further comprising a drawer façade hingingly coupled to the dresser frame adjacent the lowest drawer aperture, the drawer façade covering and alternatively exposing the lowest drawer aperture to hide or expose the safe door.

3. The dresser integrated safe apparatus of claim 1 further comprising a rail lock coupled to the safe body, the rail lock being selectively engageable with the tracks to prevent the safe body from sliding out of the lowest drawer aperture until disengaged.

4. The dresser integrated safe apparatus of claim 3 further comprising the rail lock including an actuator coupled within the safe body, the actuator selectively extending a pin through a pin aperture of the safe body to engage and alternatively disengage a pin receptacle within the track adjacent the rail lock, the actuator being in operational communication with the safe control.

5. The dresser integrated safe apparatus of claim 4 further comprising the actuator having a wireless receiver in operational communication with a transmitter of the safe control.

6. The dresser integrated safe apparatus of claim 1 further comprising each track having an upper squared U-shape portion and a lower squared U-shape portion; each drawer rail and each safe rail having an upper L-shaped extension and a lower L-shaped extension to slidingly engage within the upper U-shape portion and the lower U-shape portion of the track, respectively.

7. The dresser integrated safe apparatus of claim 1 further comprising the safe control comprising a keypad in operational communication with the door lock, the door lock including a rotary handle.

8. The dresser integrated safe apparatus of claim 1 further comprising the rotary handle having a medial bar extending across a circular perimeter, the medial bar being securable by a user to pull the safe body out of the lowest drawer aperture and to rotate the rotary handle to open the safe door.

9. A dresser integrated safe apparatus comprising:

a dresser frame including a frame top side separated from a frame bottom side, a frame left side separated from a frame right side, and a frame front side separated from a frame back side defining a frame inside, the frame front side having a plurality of drawer apertures extending through to the frame inside;

a plurality of tracks coupled to the dresser frame, the plurality of tracks being positioned on the frame left side and the frame right side within the frame inside and adjacent the drawer apertures, each track having an upper squared U-shape portion and a lower squared U-shape portion;

a plurality of drawers, each drawer having a pair of drawer rails to slidingly engage the tracks;

a safe body having a pair of safe rails to slidingly engage the tracks adjacent a lowest drawer aperture of the plurality of drawer apertures, each drawer rail and each safe rail having an upper L-shaped extension and a lower L-shaped extension to engage within the upper U-shape portion and the lower U-shape portion of the track, respectively;

a safe door hingingly coupled to the safe body, the safe door covering and alternatively exposing a safe cavity of the safe body;

a safe control coupled within the safe door, the safe control including a door lock to secure and alternatively release the safe door, the safe control comprising a keypad in operational communication with the door lock, the door lock including a rotary handle;

a rail lock coupled to the safe body, the rail lock being selectively engageable with the tracks to prevent the safe body from sliding out of the lowest drawer aperture until disengaged, the rail lock including an actuator coupled within the safe body, the actuator selectively extending a pin through a pin aperture of the safe body to engage and alternatively disengage a pin receptacle within the track adjacent the rail lock, the actuator having a wireless receiver in operational communication with a transmitter of the safe control; and a drawer façade hingingly coupled to the dresser frame adjacent the lowest drawer aperture, the drawer façade covering and alternatively exposing the lowest drawer aperture to hide or expose the safe door.

10. The dresser integrated safe apparatus of claim 9 further comprising the rotary handle having a medial bar extending across a circular perimeter, the medial bar being securable by a user to pull the safe body out of the lowest drawer aperture and to rotate the rotary handle to open the safe door.

* * * * *